United States Patent [19]

Long

[11] 4,222,529

[45] Sep. 16, 1980

[54] CYCLONE SEPARATOR APPARATUS

[76] Inventor: Edward W. Long, 5017 Shady Lake La., Lakeland, Fla. 33803

[21] Appl. No.: 950,063

[22] Filed: Oct. 10, 1978

[51] Int. Cl.[2] ..... B07B 7/00

[52] U.S. Cl. ..... 241/77; 209/17; 209/211

[58] Field of Search ..... 209/17, 3, 10, 211, 209/144; 210/512 M; 55/345; 241/77, 81

[56] References Cited

U.S. PATENT DOCUMENTS

| | | | |
|---|---|---|---|
| 2,372,514 | 3/1945 | Pootjes | 209/144 |
| 2,504,944 | 4/1950 | Atkinson | 209/211 |
| 2,648,532 | 8/1953 | Muller et al. | 209/144 X |
| 2,754,968 | 7/1956 | Vegtter et al. | 209/211 |
| 2,870,908 | 1/1959 | Fitch | 209/211 |
| 2,886,287 | 5/1959 | Croley | 209/211 X |
| 2,956,679 | 10/1960 | Hoffmann | 209/144 |
| 3,415,375 | 12/1968 | Wikdahl | 209/211 |
| 4,055,486 | 10/1977 | Choi et al. | 209/144 X |

*Primary Examiner*—Ralph J. Hill
*Attorney, Agent, or Firm*—Stein & Frijouf

[57] ABSTRACT

An apparatus for separating a material into a fine and a coarse component is disclosed incorporating a primary and a secondary cyclone separator. A primary pump is connected to the input of the primary cyclone separator for injecting material therein. The primary cyclone separator discharges the fine component of the material from a fine component output and discharges the coarse component of the material from a coarse component output. The fine component output of the primary cyclone separator is connected to the input of the secondary cyclone separator thereby producing additional fine component material and additional coarse component material. A single primary pump is utilized for the primary and secondary cyclone separators operating as a system.

11 Claims, 5 Drawing Figures

CYCLONE SEPARATOR APPARATUS

BACKGROUND OF THE INVENTION

1. Field of the Invention

This invention relates to separation and classification and more particularly to the separation of a material having a fine component and a coarse component by utilizing a cyclone separator array.

2. Description of the Prior Art

The term "cyclone separator" as used herein refers to hydrocyclones for separating a solid from a liquid and for classifying particulate matter within a slurry.

Cyclone separators have long been used for separating a material by particle size or weight. A cyclone separator generally comprises an inverted conical housing with an input tangentially communicating with the base of the conical housing. An overflow or fine component output is located in the inverted base of the conical housing whereas an underflow or coarse compound output is disposed at the apex of the conical housing. The physical configuration of the inverted conical housing causes the lighter, smaller particles to discharge from the overflow whereas the heavy, larger particles discharge from the underflow. A primary pump connected to the input of the cyclone separator creates a vortex within the cyclone to cause the separation process.

Various arrangements and configurations of multistage cyclone separators have been incorporated in the art for various applications. U.S. Pat. No. 2,372,514 shows a multistage centrifugal separating apparatus whereas U.S. Pat. No. 2,886,287 shows an array of three cyclone separators in a hydraulic cyclone separation system. This latter patent requires a primary pump for each of the cyclone separators. U.S. Pat. No. 2,965,522 utilizes a series of cyclone separators wherein the underflow of each of the cyclones is connected to the input of the next sequential cyclone separator. U.S. Pat. No. 3,441,135 illustrates a particle classification device and method utilizing an array of cyclone separators utilizing a venturi in communication with the underflow output for activating the cyclone separator. U.S. Pat. Nos. 2,372,514 and 3,441,135 relate to a dry classification process entirely distinct from the instant process. U.S. Pat. Nos. 3,485,356 and 3,486,619 illustrate other arrays of cyclone separators. Although the foregoing systems have solved many of the needs in the prior art, these systems are in general costly to operate since a primary pump is disposed between each of the cyclone stages of the system.

Therefore it is an object of this invention to provide an apparatus which overcomes the aforementioned inadequacies of the prior art devices and provides an improvement which is a significant contribution to the advancement of the classification art.

Another object of this invention is to provide an apparatus for separating a material into a fine and a coarse component incorporating a primary and a secondary cyclone separator with a single primary pump utilized for the two cyclone separators operating as a system.

Another object of this invention is to provide an apparatus for separating a material into a fine and a coarse component utilizing a simple conduit arrangement for connecting plural cyclone separators into a system.

Another object of this invention is to provide an apparatus for separating a material into a fine and a coarse component wherein diluent water is added to the coarse component output of the primary cyclone for subsequent discharge to a ball mill and sump thereby reducing the amount of diluent water required for operation.

Another object of this invention is to provide an apparatus for separating a material into a fine and a coarse component wherein each cyclone can be controlled to provide a selected size separation at each stage of the cyclone separator system.

Another object of this invention is to provide an apparatus for desliming and classifying a material into a fine component and a coarse component comprising a first, second and a third cyclone separator stage with each stage having plural cyclone separators.

Another object of this invention is to provide an apparatus for desliming and classifying a material into a fine component and a coarse component wherein the second and third cyclone separator stages further refine the fine component output and the coarse component output by producing middlings that can be separated more efficiently by a superior separation process incorporating a screen or the like.

The foregoing has outlined some of the more pertinent objects of the invention. These objects should be construed to be merely illustrative of some of the more prominent features and applications of the intended invention. Many other beneficial results can be attained by applying the disclosed invention in a different manner or modifying the invention within the scope of the disclosure. Accordingly, other objects and a fuller understanding of the invention may be had by referring to the summary of the invention and the detailed description describing the preferred embodiment, in addition to the scope of the invention defined by the claims taken in conjunction with the accompanying drawings.

SUMMARY OF THE INVENTION

The invention is defined by the appended claims to cover the disclosed embodiments shown in the attached drawings and the equivalent thereof as set forth in the detailed discussion. For the purpose of summarizing the invention, the invention may be incorporated into an apparatus for separating a material into a fine component and a coarse component. The apparatus includes a primary cyclone separator having a primary input, a primary fine component output and a primary coarse component output. A primary pump is connected to the primary cyclone separator for injecting material into the primary input. The fine component of the material discharges from the primary fine component output whereas the coarse component of the material discharges from the primary coarse component output. A secondary cyclone separator has a secondary input, a secondary fine component output and a secondary coarse component output or middlings. A middling is commonly considered to be particles of near size mesh at which product is being separated. A first connector directly connects the primary fine component output to the secondary input for producing additional fine component material from the secondary fine component output. Additional coarse component or middling of the material is produced from the secondary coarse component output. The secondary cyclone separator operates from the pressure of the primary fine component output of the primary cyclone separator. The underflow of the primary cyclone output is also under pressure preventing the primary cyclone apex from plugging at high solids density discharge.

In another embodiment of the invention, the apparatus includes plural secondary cyclone separators each having a secondary input, a secondary fine component output and a secondary coarse component output. Plural conduits enter tangentially relative to the secondary cyclone separator to interconnect the primary and secondary cyclone separators. The first connector means is void of any mechanical pressure source such as a pump or the like.

A second connector may be included for interconnecting the primary and secondary coarse component outputs. In one embodiment, the second connector connects the primary and secondary coarse component outputs to a third output of a third cyclone separator. A third coarse component output of the third cyclone separator is connected to a mill for reducing the particle size of the material emanating therefrom. The mill is connected to a sump for receiving the milled output. A third fine component output of the third cyclone separator is connected to the sump by screen means or the like. The component trapped by the screen is directed to the mill whereas the component passed by the screen is directed to the sump. The primary pump is connected to the sump for reintroducing the sump material into the primary cyclone separator.

In one embodiment, the third cyclone separator is mounted directly below the primary cyclone separator creating a vertical column. A distributor is interposed between the primary and third cyclone separators forming a modular unit for easy installation.

The invention is also incorporated into an apparatus for desliming and classifying material into a fine component and a coarse component. The apparatus comprises a first, second and a third cyclone separator stage. First means are provided for introducing the material into the first cyclone separator stage for separating the slime, the fine component and the coarse component. Second means are provided for introducing the fine component from said first cyclone separator stage into the input of the second cyclone separator stage for further desliming of the fine component. Third means are provided for introducing the coarse component from the first cyclone separator stage into the input of the third cyclone separator stage for further desliming of the coarse component.

In a more specific embodiment, each of the first, second and third cyclone separator stages comprise plural cyclone separators. Each of the stages includes a primary, a secondary and a third cyclone separation. In this embodiment, first, second and third pumps are provided in the first, second and third means for pumping the material between the various cyclone stages. In addition, a conduit connects the fine component separated by the third cyclone separator stage to the second cyclone separator stage whereas a conduit connects the coarse component separated by the second cyclone separator stage to the third cyclone separator stage. This system enables both classification and desliming in three stages whereas the prior art enables only desliming in a three stage process with a pump for each stage.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which.

Figure 3:
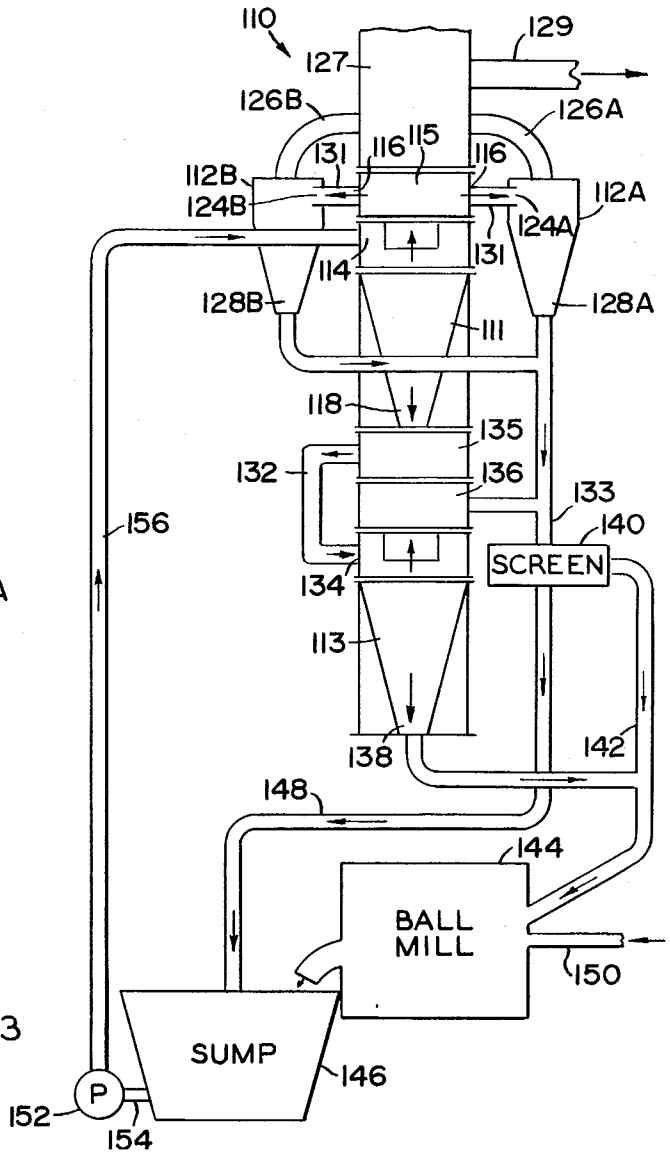
FIG. 3 is a modified form of the invention shown in FIG. 1.

Similar reference characters refer to similar parts throughout the several views of the drawings. For a more clearer understanding of the invention, the following number identifications, taken in connection with the detailed description and the drawings set forth the preferred mode or practice of the invention:

10 apparatus
11 primary cyclone separator
12 secondary cyclone separator
12A secondary cyclone separator
13 third cyclone separator
14 primary input
16 primary fine component output
18 primary coarse component output
24 secondary output
24A secondary input
24B secondary input
26A secondary fine component output
26B secondary fine component output
28A secondary coarse component output
30 conduit
31 first connector
32 second connector
33 third connector
34 third input
36 third fine component output
38 third coarse component output
40 screen
42 conduit
44 ball mill
46 sump
48 conduit
50 input conduit
111 primary cyclone separator
112A secondary cyclone separator
112B secondary cyclone separator
113 third cyclone separator
114 primary input 115 distributor
116 primary fine component output
118 primary coarse component output
124A secondary input
124B secondary input
126A secondary fine component output
126B secondary fine component output
127 overflow tank
128A secondary coarse component output
128B secondary coarse component output
129 modular output
131 first connector
132 second connector
133 third connector
134 third input
135 distributor
136 third fine component output
138 third coarse component output
140 screen
142 conduit
144 ball mill
146 sump
52 primary pump
54 conduit
56 conduit
154 conduit
156 conduit
201 first stage
211 primary cyclone separator
212 secondary cyclone separator
213 third cyclone separator
216 primary fine component output
218 coarse component output
224 secondary input
226 fine component output
228 coarse component output
230 diluent input
231 first connector
232 second connector
233 third connector
234 third input
236 third fine component output
238 third coarse component output
239 fine product reservoir
242 conduit
243 coarse reservoir
246 sump
252 first pump
252 conduit
256 conduit
260 dilution conduit
148 conduit
150 input conduit
152 primary pump
301 second stage
311 primer
312 secondary cyclone separator
313 third cyclone separator
314 primary input
316 primary fine component output
318 coarse component output
324 secondary input
326 fine component output
328 coarse component output
330 diluent input
331 first connector
332 second connector
334 third input
336 third fine component output
338 third coarse component output
339 fine product reservoir
342 conduit
352 second pump
354 conduit
356 conduit
401 third stage
411 primer
412 secondary cyclone separator
413 third cyclone separator
414 primary input
414 primary input
416 primary fine component output
418 coarse component output
424 secondary input
426 fine component output
428 coarse component output
430 diluent input
431 first connector
432 second connector
434 third input
436 third fine component output
438 third coarse component output
440 screen
442 conduit
448 conduit
452 third pump
454 conduit
456 conduit
461 coarse product reservoir
470 conduit
472 screen
474 conduit
478 conduit

DETAILED DISCUSSION

Figure 2:
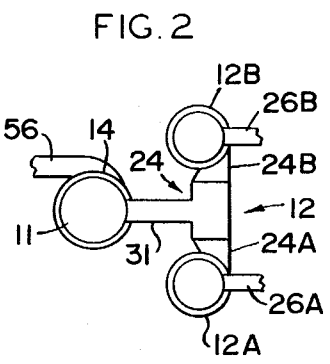
FIG. 2 is a partial top view of the cyclone separators shown in FIG. 1.
Figure 1:
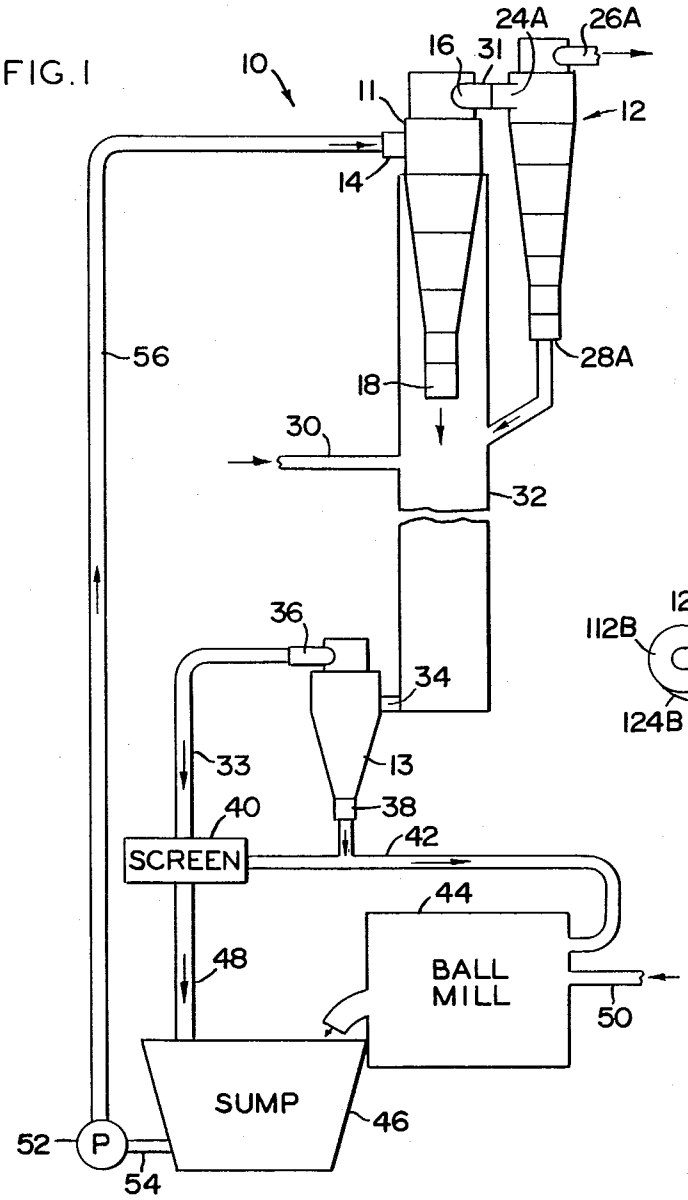
FIG. 1 is a diagram of an apparatus for separating material into a coarse component and a fine component and two middling products utilizing the present invention.

FIGS. 1 and 2 illustrate an apparatus 10 for separating a material into a fine component and a coarse component as well as two middling products. The apparatus comprises a primary cyclone separator 11, a secondary cyclone separator 12 and an optional third cyclone separator 13. The primary cyclone separator 11 has a primary input 14, a primary fine component output 16 and a primary coarse component output 18. The fine component output 16 is commonly termed an overflow whereas the coarse component output 18 is commonly termed an underflow. The secondary cyclone separator 12 comprises a secondary input 24 positioned in proximity to the fine component output 16 of the primary cyclone separator 11. The secondary cyclone separator 12 in FIG. 2 comprises plural cyclone separators 12A and 12B incorporating secondary inputs 24A and 24B and fine component outputs 26A and 26B. The cyclone separators 12A and 12B include secondary coarse or middling component outputs with one being shown as 28A. The fine component output 16 of the primary cyclone separator 11 is connected by a first connector 31 to the secondary inputs 24A and 24B of cyclone separator 12. A second connector 32 joins the outputs 18 and 28A of the primary and secondary cyclones 11 and 12. Water diluent may be added through conduit 30. The second connector means 32 couples the primary and secondary cyclones to the third input 34 of third cyclone separator 13. The fine component output 36 is connected by a third connector 33 to a screen 40. The third coarse component output 38 is discharged to a conduit 42 which interconnects screen 40 and ball mill 44. Ball mill 44 discharges into a sump 46 which sump also receives material passed by screen 40 through a conduit 48. Input material is introduced into a conduit 50 to ball mill 44. A primary pump 52 receives material by conduit 54 from sump 46 to introduce material by conduit 56 into the primary input 14 of the first cyclone separator 11.

The apparatus 10 operates in the following manner. Raw material is introduced into ball mill 44 through conduit 50. The output of ball mill 44 discharges into sump 46 to be drawn by pump 52 through conduit 54 for introduction into the primary input 14 via conduit 56. The primary cyclone separator 11 discharges the coarse components through coarse component output 18 into second connector 32. The fine components of the material are introduced into the secondary cyclone separators 12A and 12B for further separation. The fine components of the second cyclone separator 12 discharge through secondary fine component outputs 26A and 26B. The coarse component or middlings of the material discharges from the secondary coarse component output 28A and enter conduit 32. Water diluent is introduced through conduit 30 to aid the introduction of the coarse component into the input 34 of third cyclone separator 13. The fine component or middling is discharged from the fine component output 36 through third connector 33 to separator means 40. This separator 40 is shown as a screen but it is understood that other separators may be employed such as hydraulic or the like. The small particles passing through screen 40 are directed by conduit 48 into sump 46. The larger particles trapped by screen 40 are directed through conduit 42 along with the coarse component output 38 of third cyclone separator 13 to ball mill 44. Accordingly, the coarse material is again milled by ball mill 44. The embodiments shown in FIGS. 1 and 2 is adaptable to a process requiring basic ore grinding. The apparatus 10 is suitable for the process of beneficiating minerals of lead, zinc, copper, iron and the like. This process incorporates a two-stage classification wherein the primary classification is accomplished by cyclone separators 11, 12 and 13 wherein the secondary classification is accomplished by screen 40. Although the screen 40 is more positive in classification than the cyclone separators, the use of cyclone separators 11-13 enables only the middlings which are a small percentage of the ore entering input 14 to be passed through screen 40. Accordingly, the arrangement of cyclone separators set forth in FIGS. 1 and 2 insures that the majority of ore is classified without the use of screen 40.

Figure 4:
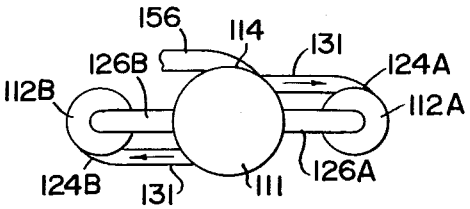
FIG. 4 is a partial top view of the cyclone separators shown in FIG. 3.

FIGS. 3 and 4 illustrate a modification 110 of the invention shown in FIGS. 1 and 2 wherein the cyclone separators are established in a modular arrangement. Similar components are labeled with similar reference numerals raised by 100 units. In this embodiment, the raw material enters conduit 150 to ball mill 144. The discharge of ball mill 144 enters sump 146 to be drawn through conduit 154 by pump 152. The material is introduced through conduit 156 into primary input 114 of primary cyclone separator 111. The fine component separated by the primary cyclone separator 111 enters a distributor 115 for discharge from the primary fine component output 116 into a first connector 131 to enter the inputs 124A and 124B of the secondary cyclone separators 112A and 112B. The fine component outputs 126A and 126B of cyclone separators 112A and 112B enter an overflow 127 to exit from a modular output 129. This output is ready for additional processing as desired.

The coarse component output 118 of the first cyclone separator 111 enters a distributor 135 which is connected by second connector 132 to an input 134 of the third cyclone separator 113. The material emanating from the third coarse component output 138 enters conduit 142 to be returned to ball mill 144. The coarse component from outputs 128A and 128B of the secondary cyclone separators 112A and 112B pass by third connector 133 to screen 140. The third fine component output 136 of third cyclone separator 113 is similarly introduced into third connector 133 to screen 140. The small particle size component passing through screen 140 is channelled by conduit 148 to sump 146. The large size component trapped by screen 140 is passed through conduit 142 to return to ball mill 144.

It should be appreciated that the system set forth in FIGS. 3 and 4 is a modular system wherein the first, second and third cyclone separators 111–113 form a system which is interconnected by stacking cyclone units into a vertical column. Suitable fastening means secure the cyclone units into the system shown. It also should be understood that the coarse component outputs of the secondary cyclone separators 112A and 112B communicate to screen 140 without passing through the third cyclone separator 113 in contrast to the embodiment shown in FIG. 1. The arrangement set forth in FIGS. 3 and 4 provides superior performance for certain applications.

Figure 5:
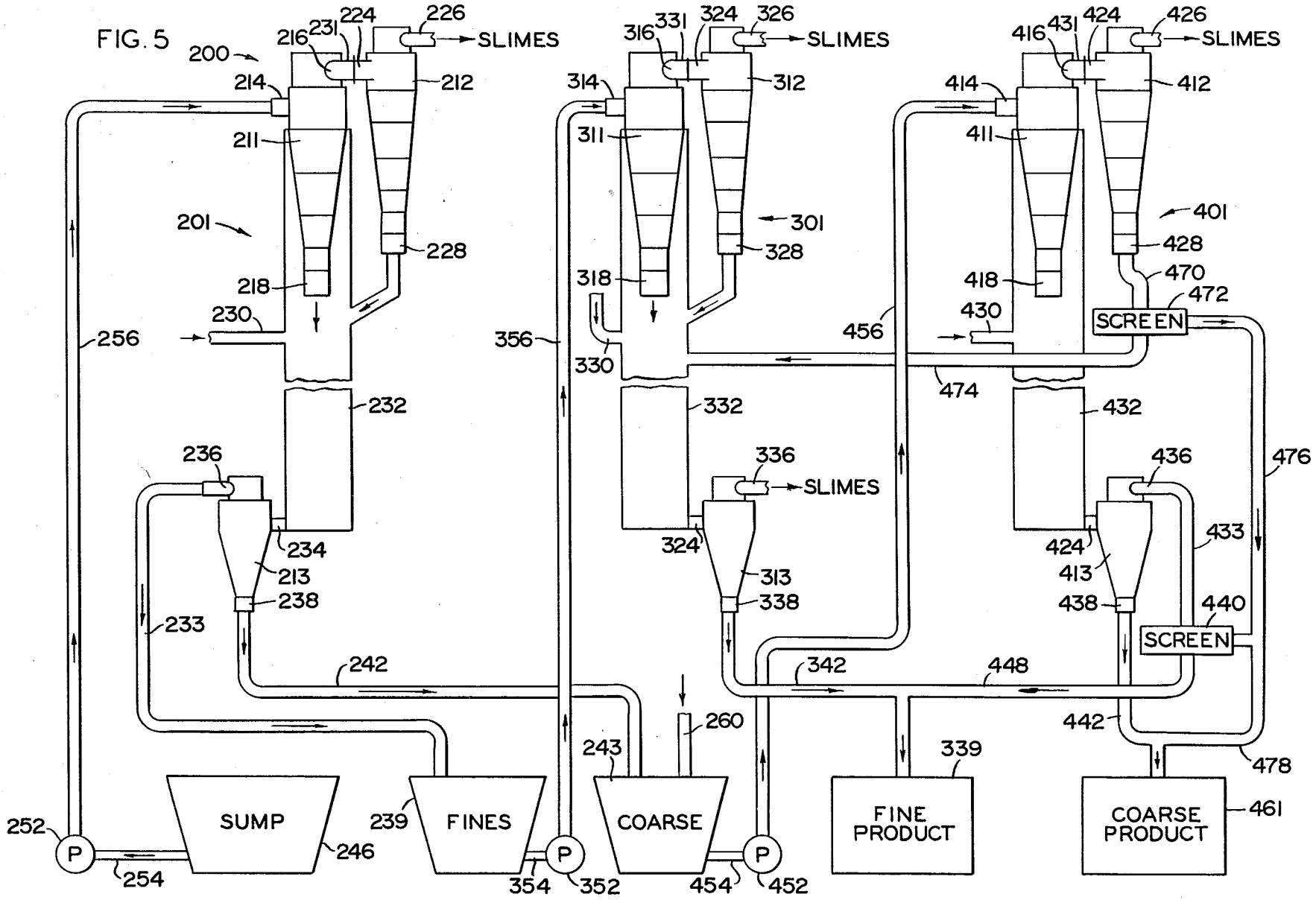
FIG. 5 is an apparatus for desliming and classifying a material into a fine component and a coarse component utilizing the present invention.

FIG. 5 illustrates an apparatus 200 for desliming and classifying a material into a fine component and a coarse component. The apparatus 200 comprises a first cyclone separator stage 201, a second cyclone separator stage 301, and a third cyclone separator stage 401. Each of the cyclone separator stages comprises three cyclones separators connected in a manner similar to that set forth in FIG. 1. The first stage 201 comprises a primary cyclone separator 211 connected to a secondary cyclone separator 212. A third cyclone separator 213 is also included in the first stage 201. Primary cyclone 211 comprises an input 214, a fine component output 216 and a coarse component output 218. The secondary cyclone separator 212 comprises an input 224, a fine component output 226 and a coarse component output 228. A first connector 231 interconnects the output 216 to the input 224 whereas conduit 232 receives the output 218 and 228 of cyclones 211 and 212. An input 234 of third cyclone 213 receives material from conduit 232 and discharges from a third fine component output 236 and a third coarse component output 238. Fine component output 236 is connected by a third connector 233 to a fine reservoir whereas the coarse output 238 is connected by a connector 242 to a coarse reservoir 243.

A sump 246 receives the material to be deslimed and classified and is drawn therefrom through conduit 254 by a first means shown as pump 252 to inject the material into input 214 by conduit 256. The fine material from reservoir 239 is drawn by second means shown as pump 352 through conduit 354 for injection into primary input 314 through conduit 356. The fine output 316 of primary cyclone 311 is connected by a first conduit 331 to the input 324 of secondary cyclone 312. The output 326 of secondary cyclone 312 discharges unwanted slimes from the fine material. The outputs 318 and 328 of the cyclones 311 and 312 are diluted by a dilution conduit 330 in first connector 332 to enter the input 334 of third cyclone 313. The output 336 of third cyclone 313 further eliminates slimes from the fine component. The output 338 of third cyclone 313 is connected by a conduit 342 to a fine product reservoir 339. The coarse material in coarse reservoir 243 is diluted by conduit 260 and drawn by third pump 452 through conduit 454 to be injected into input 414 of first cyclone 411 through conduit 456. The fine component output 416 is connected by a first connector 431 to input 424 of secondary cyclone 412. Fine component output 426 of the secondary cyclone 412 discharges slimes from the material entering input 414. The output 418 of first cyclone 411 is diluted by a dilution conduit 430 in first conduit 432 to enter input 434 of third cyclone 413. The fine component output 436 of third cyclone 413 is connected by third conduit 433 to screen 440. The material passed by screen 440 is connected by conduit 448 to the fine product reservoir 339. The coarse component output 438 of third cyclone 413 is connected by a conduit 442 to a coarse product reservoir 461.

The coarse component output 428 of the secondary cyclone 412 is connected by conduit 470 to a screen 472. Material passed by screen 472 is directed by conduit 474 into the second conduit 332 for further desliming by cyclone 313. The larger particle size material trapped by 472 is directed by conduit 476 to be added to the material trapped by screen 440 to enter coarse product reservoir 461 through conduit 478.

The apparatus 200 shown in FIG. 5 provides a novel means for desliming and classifying material. The material from sump 246 is directed into the first stage 201 which produces fine material components into reservoir 239 and coarse material components into reservoir 243. The fine components from reservoir 239 are processed by the second stage 301 to further deslime the fine components. Second stage 301 completes a three step desliming process with the fine product entering fine product reservoir 239. The coarse component from reservoir 243 is further processed by the third stage 401 of the apparatus 200. Cyclones 411 and 412 deslime the coarse component with the coarse output from the second cyclone 412 being separated by screen 472. Material passed by the screen 472 is returned by conduit 474 for further desliming by third cyclone 313. Material trapped by screen 472 is directed to the coarse product reservior 461. In a similar manner, the coarse component output 418 is further refined by third cyclone 413. The fine component output 436 is directed to screen 440. Material passing through screen 440 is directed to the fine product reservoir 339. Material trapped by screen 440 is directed to the coarse product reservoir 461 along with the coarse component output 438 of third cyclone 413.

The foregoing disclosure has disclosed various systems for classifying and desliming materials. The invention shown in FIGS. 1–4 are suitable when a milling process is involved for producing a fine material. The apparatus illustrated in FIG. 5 is a novel means for desliming material and also classifying the materials by particle size. It should be appreciated that the various aspects of each and every figure may be interchanged with other figures to produce further embodiments which are a former part of this invention.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

Now that the invention has been described, what is claimed is:

1. An apparatus for separating a material into a fine component and a coarse component, comprising in combination:

a primary cyclone separator having a primary input, a primary fine component output and a primary coarse component output;

a primary pump connected to said primary cyclone separator for injecting the material into said primary input with the fine component of the material emanating from said primary fine component output and with the coarse component of the material emanating from said primary coarse component output;

a secondary cyclone separator having a secondary input, a secondary fine component output and a secondary coarse component output;

first connector means for directly connecting said primary fine component output to said secondary input for producing additional fine component of the material from said secondary fine component output and for producing additional coarse component of the material from said secondary coarse component output from the pressure of said primary fine component output;

second connector means for interconnecting said primary and secondary coarse component outputs;

a third cyclone separator having a third input, a third fine component output and a third coarse component output;

said second connector means interconnecting said primary and secondary coarse component output to said third input;

said third coarse component output being connected to a mill for reducing the size of the material emanating from said third coarse component output and discharging the mill output into a sump;

screen means for separating the output from said third fine component output;

means for directing material trapped by said screen means to said mill; and means for directing the material passing through said screen means to said sump.

2. An apparatus as set forth in claim 1, including plural secondary cyclone separators each having a secondary input, a secondary fine component output and a secondary coarse component output.

3. An apparatus as set forth in claim 2, wherein said first connector means includes plural conduits.

4. an apparatus as set forth in claim 3, wherein said third cyclone separator is mounted directly below said primary cyclone separator forming a vertical column.

5. An apparatus as set forth in claim 2, wherein said first connector means includes plural conduits entering tangentially relative to said secondary cyclone separator.

6. An apparatus as set forth in claim 2, wherein said first connector means includes a substantially T-shaped conduit.

7. An apparatus as set forth in claim 1, wherein said first connector means is void of a mechanical pressure source.

8. An apparatus as set forth in claim 1, including a distributor interposed between said primary and third cyclone separator.

9. An apparatus as set forth in claim 1, including means for connecting said sump to the input of said primary pump for introducing the sump material into said primary cyclone separator.

10. An apparatus for separating a material into a fine component and a coarse component, comprising in combination:

a primary cyclone separator having a primary input, a primary fine component output and a primary coarse component output;

a primary pump connected to said primary cyclone separator for injecting the material into said primary input with the fine component of the material emanating from said primary fine component output and with the coarse component of the material emanating from said primary coarse component output;

a secondary cyclone separator having a secondary input, a secondary fine component output and a middling component output;

first connector means for directly connecting said primary fine component output to said secondary input for producing additional fine component of the material from said secondary fine component output and for producing middling component of the material from said middling component output from the pressure of said primary fine component ouptut;

said primary coarse component output being connected to a mill for reducing the size of the material emanating from said primary coarse component output and discharging the mill output into a sump;

mechanical separator means including screen means for separating the middling component discharged from said middling component output;

means for directing material trapped by said mechanical separator means to said mill; and means for directing the material passing through said mechanical separator means to said sump.

11. An apparatus as set forth in claim 10, including means for connecting said sump to the input of said primary pump for introducing the sump material into said primary cyclone separator.

* * * * *

UNITED STATES PATENT AND TRADEMARK OFFICE

CERTIFICATE OF CORRECTION

PATENT NO. : 4,222,529

DATED : September 16, 1980

INVENTOR(S) : Edward W. Long

It is certified that error appears in the above—identified patent and that said Letters Patent is hereby corrected as shown below:

Column 6, line 13, delete "414 primary input".

Signed and Sealed this

Sixth Day of January 1981

[SEAL]

*Attest:*

SIDNEY A. DIAMOND

*Attesting Officer*

*Commissioner of Patents and Trademarks*